US008418422B2

(12) United States Patent
Johnson, III

(10) Patent No.: US 8,418,422 B2
(45) Date of Patent: Apr. 16, 2013

(54) WALL ANCHORING DEVICE AND METHOD

(75) Inventor: Ralph O. Johnson, III, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 81 days.

(21) Appl. No.: 13/010,821

(22) Filed: Jan. 21, 2011

(65) Prior Publication Data

US 2012/0186183 A1 Jul. 26, 2012

(51) Int. Cl.
*E04B 1/16* (2006.01)
*E04B 2/30* (2006.01)
*E04C 1/40* (2006.01)

(52) U.S. Cl.
USPC ..... 52/379; 52/513; 52/713; 52/565; 52/568

(58) Field of Classification Search ..... 52/379, 52/513, 713, 562, 565, 568, 426
See application file for complete search history.

(56) References Cited

U.S. PATENT DOCUMENTS 4,596,102 A * 6/1986 Catani et al. ..... 52/508
4,738,070 A * 4/1988 Abbott et al. ..... 52/710
4,819,401 A * 4/1989 Whitney, Jr. ..... 52/713
4,875,319 A * 10/1989 Hohmann ..... 52/383
4,946,632 A * 8/1990 Pollina ..... 264/33
5,408,798 A * 4/1995 Hohmann ..... 52/562
5,454,200 A * 10/1995 Hohmann ..... 52/513
5,490,366 A * 2/1996 Burns et al. ..... 52/713
5,634,310 A * 6/1997 Hohmann ..... 52/513
5,671,578 A * 9/1997 Hohmann ..... 52/562
5,845,455 A * 12/1998 Johnson, III ..... 52/713
6,279,283 B1 * 8/2001 Hohmann et al. ..... 52/379
6,351,922 B1 * 3/2002 Burns et al. ..... 52/713
6,553,737 B1 * 4/2003 Berg ..... 52/687
6,668,505 B1 * 12/2003 Hohmann et al. ..... 52/565
6,735,915 B1 * 5/2004 Johnson, III ..... 52/379
6,789,365 B1 * 9/2004 Hohmann et al. ..... 52/565

(Continued)

OTHER PUBLICATIONS

Wire-Bond, Truss Adjustable Tab Lock Seismic System, Date First Published Unknown, Date Captured Dec. 10, 2012, http://wirebond.com/wp-content/uploads/2009/12/tab_lock_truss_seismic.pdf, p. 1.*

*Primary Examiner* — Joshua J Michener
*Assistant Examiner* — Elizabeth A Plummer
(74) *Attorney, Agent, or Firm* — Shumaker, Loop & Kendrick, LLP

(57) ABSTRACT

A masonry anchor and method of use for connecting first and second spaced-apart walls defining a cavity therebetween, the anchor including an anchor bracket including a slot and a pintle engaging and carried by the anchor bracket and extending outwardly from the anchor bracket and bridging a cavity between the first and second walls. The pintle includes first and second laterally spaced-apart hooks for being positioned and locked in the slot of the anchor bracket. The hooks have a nominal spacing between them that is greater than a width of the slot, and are deformable into a position wherein the hooks are spaced apart by a distance that is less than the width of the slot for allowing the hooks to be inserted into the slot, and have sufficient positional memory to return from its deformed position to its nominal spacing when manual pressure is released.

15 Claims, 5 Drawing Sheets

U.S. PATENT DOCUMENTS 6,851,239 B1 * 2/2005 Hohmann et al. ..... 52/513
7,325,366 B1 * 2/2008 Hohmann et al. ..... 52/513
7,735,292 B2 * 6/2010 Massie ..... 52/742.14
7,966,784 B2 * 6/2011 Wobber ..... 52/513
8,096,090 B1 * 1/2012 Hohmann et al. ..... 52/513
8,122,663 B1 * 2/2012 Hohmann et al. ..... 52/379

* cited by examiner

WALL ANCHORING DEVICE AND METHOD

TECHNICAL FIELD AND BACKGROUND OF THE INVENTION

1. Field of the Invention

The present invention relates generally to the field of masonry anchors for use in connecting two spaced apart masonry walls, for example brick veneer and concrete block, to form a unified wall structure, and more particularly, to a truss-adjustable tab lock seismic locking device and method for connecting spaced apart masonry walls.

2. Background of the Invention

It is common in masonry construction for wall structures to include an inner wall, typically of concrete block construction to provide structural stability, and a spaced-apart outer veneer wall, typically of brick, principally for aesthetic purposes. Masonry anchors have long been used for anchoring the two walls together to help form a unified wall structure.

Prior art masonry anchors are generally made of metal wire and typically include a ladder or truss-type support frame that is positioned in a mortar joint of the inner wall laterally coplanar with a mortar joint in the outer wall. A plurality of brackets extend outwardly from the support frame and have eyes extending into the cavity between the two walls for receiving a connecting member, such as a pintle, having elongate hooks for being positioned in the eyes to thereby form a unitary anchor spanning the cavity. The outer end of the pintle rests on the top surface of the outer wall. Mortar is then filled over the masonry anchor. The process is repeated for successive mortar joints to unify the two walls into a single stable structure.

In geographical areas subject to seismic disturbance, building codes require an anchor whose parts are connected in such a manner as not to disconnect during a seismic disturbance that may cause relative movement between the two walls. The masonry anchor of the present invention is particularly adapted for use in geographical areas subject to seismic instability, and results in improved structural stability in the wall structure. The anchor embodiments provided herein are readily and easily installed in the wall structure during construction without the need of special tools, jigs or fixtures. The anchor is characterized by two anchor elements being locked together in manner that prevents their separation even under extreme pressure and movement.

BRIEF SUMMARY OF THE INVENTION

Therefore, it is an object of the present invention to provide a masonry anchor for use in areas of seismic instability, or in other applications where anchor components may otherwise detach from each other.

It is another object of the invention to provide a masonry anchor that is easily and quickly installed.

It is another object of the invention to provide a method of securing together spaced-apart masonry walls, particularly in areas of seismic instability, or in other applications where anchor components may otherwise detach from each other.

These and other objects and advantages of the invention are achieved by providing in one embodiment a method for anchoring first and second spaced apart walls together to form a single wall structure including the steps of:

(a) providing a masonry anchor according to an embodiment of the invention;

(b) positioning the anchor bracket on a top surface of the first wall;

(c) connecting the hooks of the pintle to the anchor bracket by narrowing the spacing between the hooks to a spacing that is less than the width of the slot, inserting the hooks into the slot of the anchor bracket, and returning the spacing between the hooks to their nominal spacing thereby locking the hooks in the slot;

(d) positioning the pintle on a top surface the second wall in vertical spaced-apart alignment with the top surface of the first wall; and (e) embedding the anchor bracket and pintle into a mortar joint by applying mortar to the top surface of the first wall and the second wall thereto form a single wall structure.

In one embodiment, the masonry anchor includes an anchor bracket for being embedded in a mortar joint of the first wall, the anchor bracket including a widthwise slot at an outer end thereof, and a pintle for being attached to and carried by the anchor bracket and adapted for extending outwardly from the anchor bracket and bridging a cavity between the first and second walls, the pintle including first and second laterally spaced-apart hooks for being positioned and locked in the slot of the anchor bracket, the hooks having a nominal spacing between them that is greater than a width of the slot.

According to another embodiment of the invention, the pintle is formed of a material that is deformable by manual pressure to narrow the distance between the hooks and has sufficient positional memory to return from its deformed position to its nominal spacing when the manual pressure is released.

According to another embodiment of the invention, the anchor bracket and pintle are formed of wire.

According to another embodiment of the invention, a masonry anchor is provided for connecting first and second spaced-apart walls defining a cavity therebetween, the masonry anchor including:

(a) an anchor bracket for being embedded in a mortar joint of the first wall, the anchor bracket including a widthwise slot at an outer end; and (b) a pintle is for being attached to and carried by the anchor bracket and for extending outwardly from the anchor bracket and bridging the cavity, the pintle including first and second laterally spaced-apart hooks for being positioned and locked in the slot of the anchor bracket, the hooks have a nominal spacing between them that is greater than a width of the slot, and are deformable into a position wherein the hooks are spaced apart by a distance that is less than the width of the slot for allowing the hooks to be inserted into the slot, the hooks having a sufficient positional memory to return from their deformed position to their nominal spacing when the manual pressure is released.

According to another embodiment of the invention, the anchor bracket is constructed of wire formed into a predefined shape defining a central void.

According to another embodiment of the invention, the anchor bracket is constructed of wire formed into a frame having a quadrilateral periphery defining a central void, and the slot in the anchor bracket is formed by a cross-member attached to the wire.

According to another embodiment of the invention, the anchor bracket is constructed of wire formed into a frame having a rectangular periphery defining a central void, and the slot in the anchor bracket is formed by a cross-member attached to the wire across opposed parallel portions of the wire adjacent an outer end of the anchor bracket.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Figure 1:
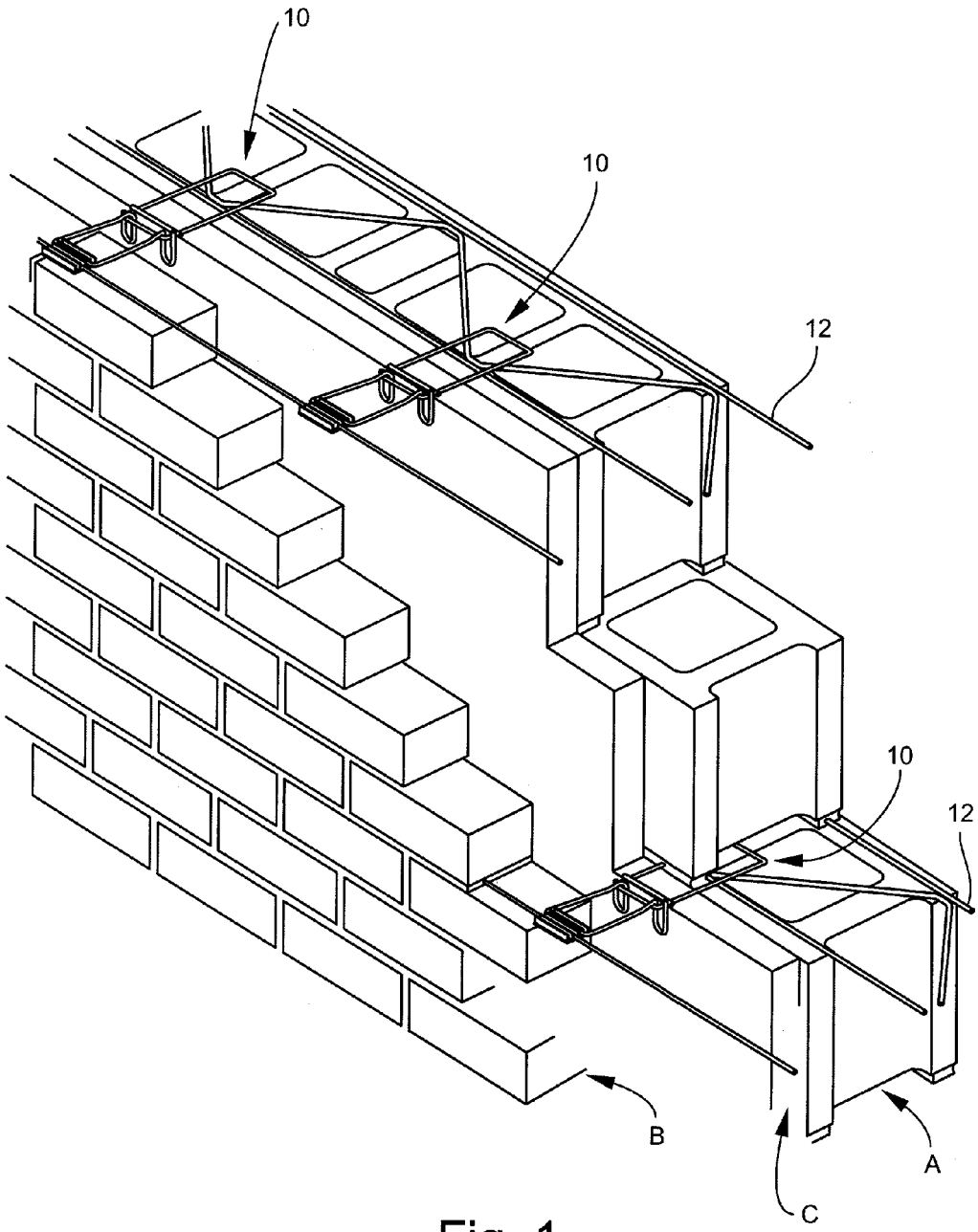
FIG. 1 is a perspective view of a section of masonry wall construction showing the placement of a plurality of masonry anchors according to one embodiment of the invention.

Referring to FIG. 1, a plurality of masonry anchors used in the construction of a masonry wall are shown generally at reference numeral 10. In the partial construction shown, first wall 'A' made of concrete block is attached to second wall 'B' made of brick veneer through the plurality of anchors 10. First and second walls 'A' and 'B' are spaced-apart and define cavity 'C' therebetween, which in the embodiment shown, is occupied by a layer of foam insulation, for example spray foam applied to the outwardly facing surface of first wall 'A'. It is envisioned that other materials including, but not limited to insulating and water-blocking materials, may occupy cavity 'C', and cavity 'C' may have any predetermined width.

As shown, masonry anchors 10 are installed at predetermined intervals along the length and height of the wall with the number of anchors 10 required for adequate attachment of the walls being dependent upon the dimensions of the wall and magnitude of anticipated seismic activity in the geographic installation area. Each masonry anchor 10 is installed overlying substantially horizontally-aligned courses of blocks and bricks of the first and second walls (i.e. walls 'A' and 'B' include corresponding mortar joints generally residing in the same horizontal plane), respectively, such that the anchors 10 are positioned generally parallel to gravitational horizontal and span cavity 'C'. Masonry anchors 10 are held in place by overlying courses of blocks and bricks and embedding within the mortar between courses to resist against lateral pulling forces. As described in detail below, masonry anchors 10 preferably have a cross-sectional wire thickness less than or equal to the predetermined mortar thickness between courses so as to not interfere with the planarity of courses or be visible from the sides of the walls 'A' and 'B'.

Each masonry anchor 10 is attached to, such as by welding, truss-type framework 12 positioned between courses of the first wall 'A' and oriented generally coplanar with the anchors 10 of that course. Truss-type framework 12 is preferably provided in long lengths and thus multiple masonry anchors 10 may be attached to a common section of truss-type framework 12 along one side thereof. Attachment of anchors 10 to truss-type framework 12 may or may not include overlapping of these components, and preferably includes abutting attachment such that no overlapping occurs to maintain a low profile. In one example, truss-type framework 12 includes parallel, elongate, spaced-apart linear rods interconnected through angled or perpendicular rods welded thereto, although alternate structures are envisioned. When properly installed, neither masonry anchors 10 nor attached framework 12 protrude beyond the exterior faces of the combined wall.

Figure 2:
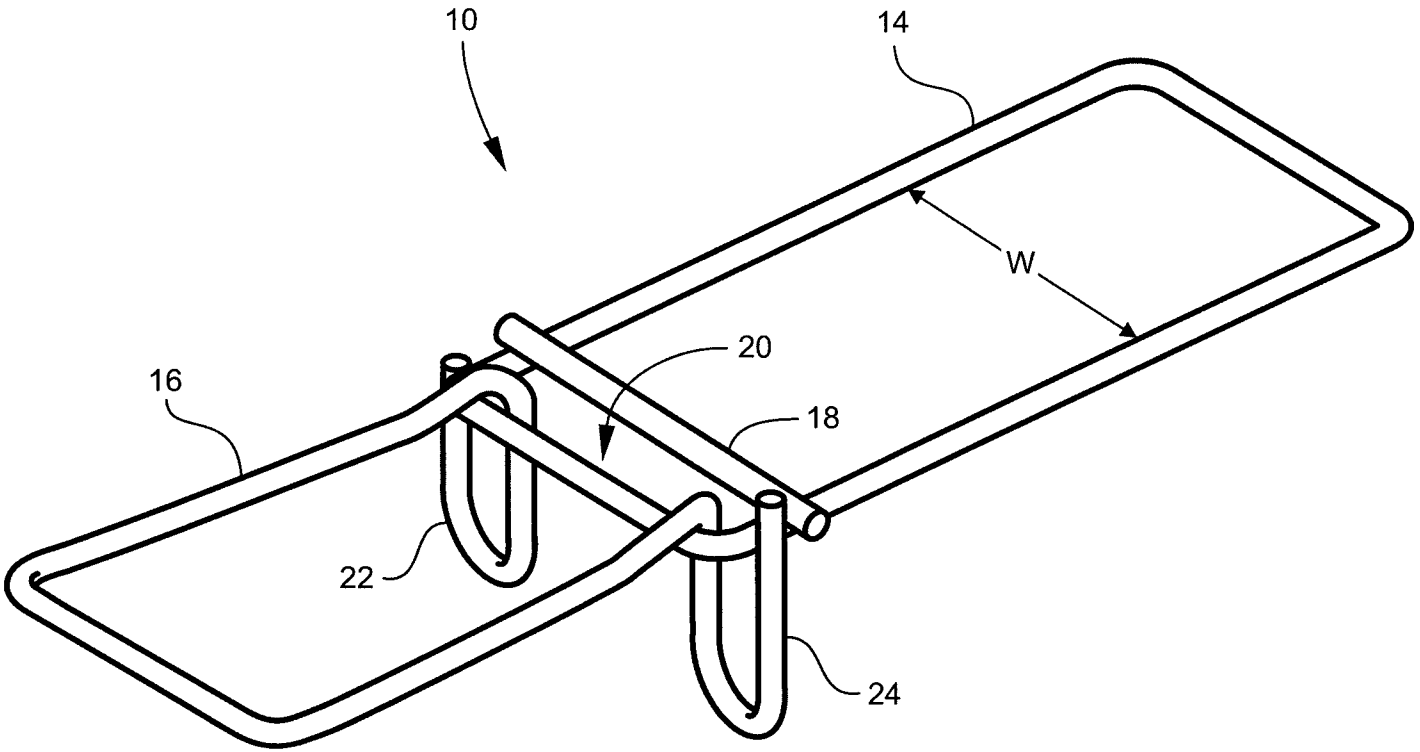
FIG. 2 is a perspective view of a masonry anchor according to one embodiment of the invention.

Referring to FIG. 2, each masonry anchor 10 includes anchor bracket 14 and pintle 16, both preferably formed of bent steel wire. Anchor bracket 14 is bent to define a continuous rectangle having radiussed corners and further includes cross-member 18 welded across the width 'w' of anchor bracket 14 adjacent, but spaced-apart from, one end. Cross-member 18 provides dimensional stability to anchor bracket 14 and forms slot 20 with the adjacent side of anchor bracket 14 and serves as a thickness guide to assist in the application of the correct thickness of spray foam to the concrete block wall 'A', see FIG. 1. The applicator preferably applies the foam to a thickness whereby only approximately the portion of anchor bracket 14 forming slot 20 extends outwardly beyond the thickness of the layer of the wall foam.

Pintle 16 is generally U-shaped and terminates at its free ends in two hooks 22, 24 formed by bending the ends of pintle 16 downward and then upward such that the free ends of hooks 22, 24 point upward when installed. Hook 24 is longer than hook 22 and importantly extends upwardly above the level of cross-member 18 of anchor bracket 14, while hook 22 ends in about vertical alignment with cross-member 18. The distance between hooks 22 and 24 is greater than the width 'w' of slot 18. The longer length of hook 42 necessitates stepped attachment of pintle 16 to anchor bracket 14 as detailed in FIGS. 4-7, and provides protection against pintle 16 and anchor bracket 14 becoming detached during a seismic event (i.e. vertical displacement of second wall 'B' relative to first wall 'A').

Figure 3:
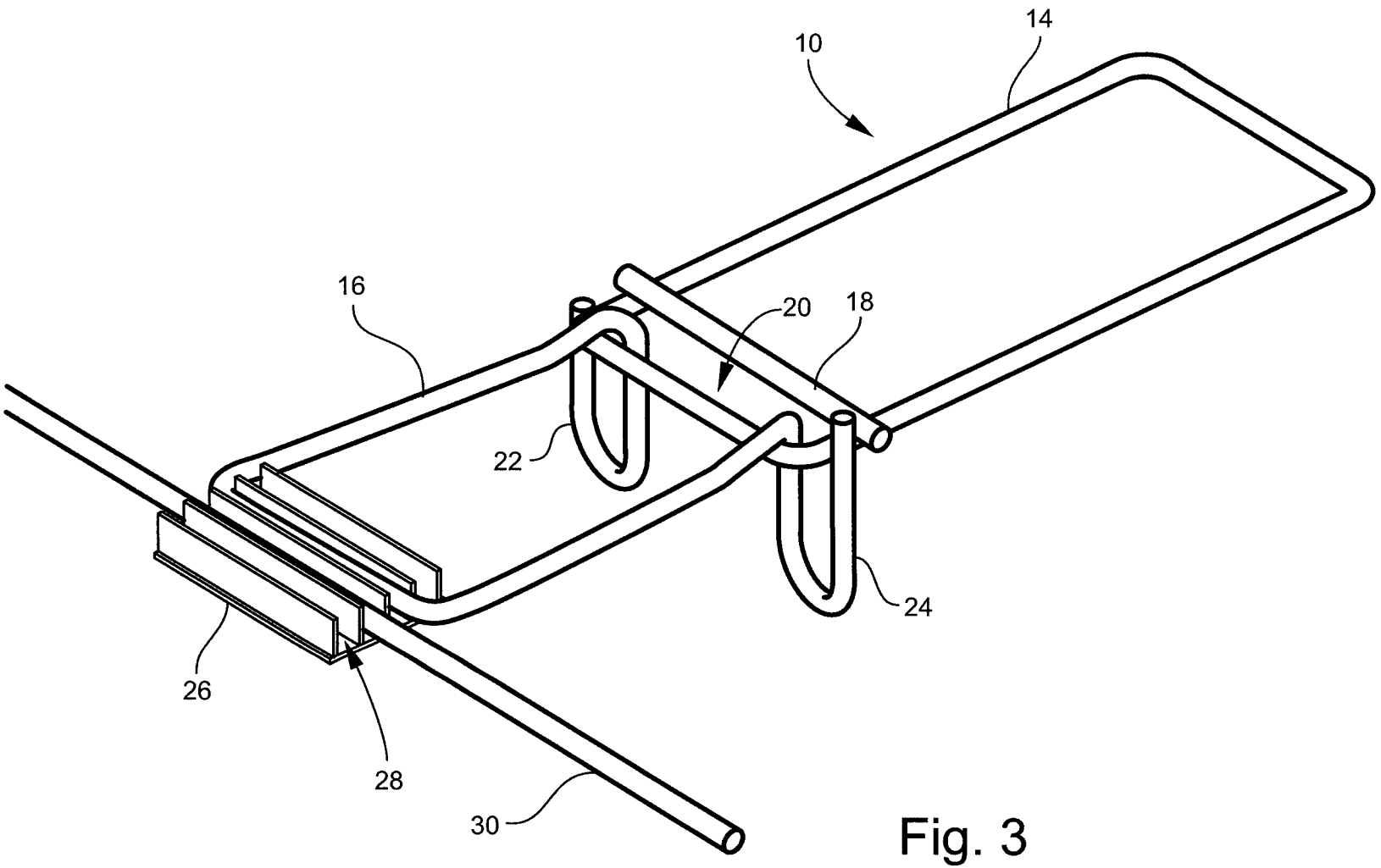
FIG. 3 is a perspective view of a masonry anchor according to one embodiment of the invention with a seismic clip attached to the pintle.

Referring to FIG. 3, masonry anchor 10, and particularly pintle 16 thereof, may be attached at the end secured within second wall 'B' to seismic clip 26, which as shown in FIG. 1 is positioned on the top of a course of brick of wall 'B'. Seismic clip 26 is thus clipped to the outer end of pintle 16 apart from anchor bracket 14. Seismic clip 26 includes a plurality of parallel channels 28 for adjustably receiving pintle 16 and elongate steel rod 30 in the horizontal plane. When engaged in a channel 28 of seismic clip 26, steel rod 30 is oriented perpendicular to the longitudinal axis of masonry anchor 10, and thus seismic clip 26 and steel rod 30 overly a course of brick and are fully embedded in the mortar between courses. As shown in FIG. 1, steel rod 30 extends along the length of the course of second wall 'B', providing further strength to the wall structure, particularly along its length, while providing secure attachment of pintle 16 into the mortar of the mortar joint.

Referring to FIGS. 4-7, one sequence of steps for properly attaching pintle 16 to anchor bracket 14 is shown in detail.

Figure 4:
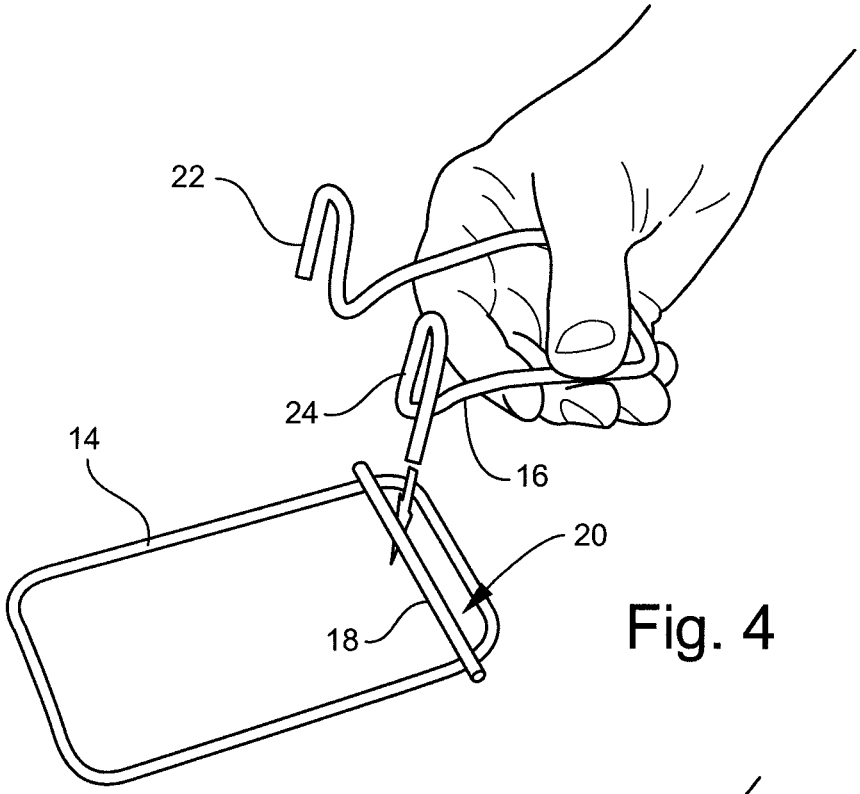
FIG. 4 shows the first step in attaching the anchor and pintle components of the anchor system.
Figure 5:
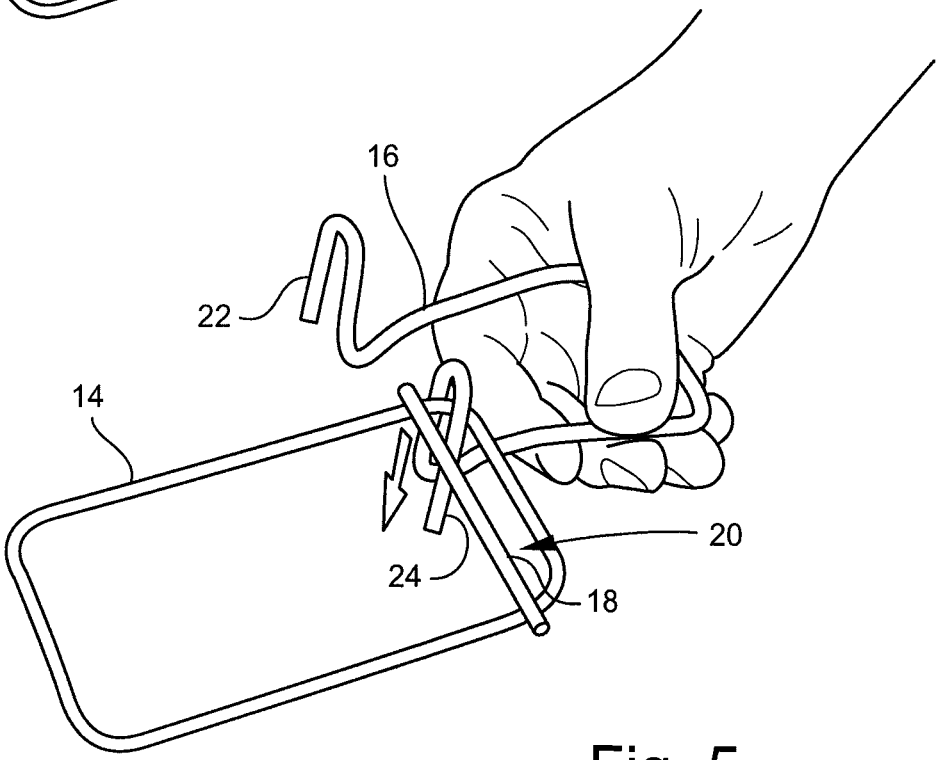
FIG. 5 shows the first hook of the pintle engaging the anchor bracket.
Figure 6:
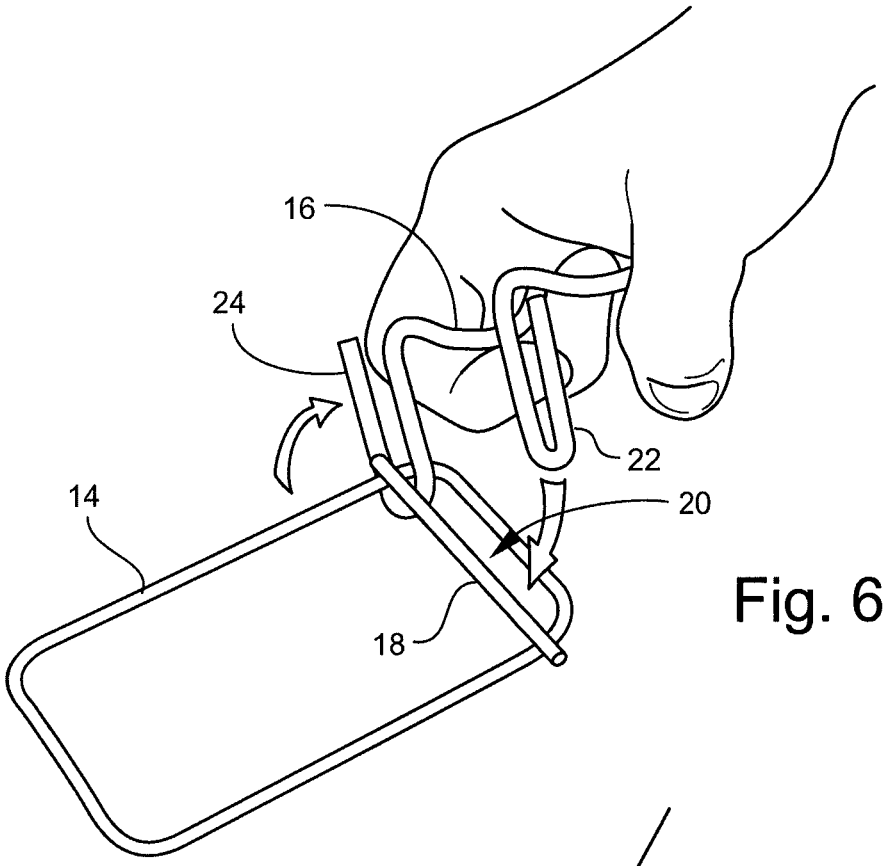
FIG. 6 shows the second hook of the pintle in alignment ready to engage the anchor bracket.
Figure 7:
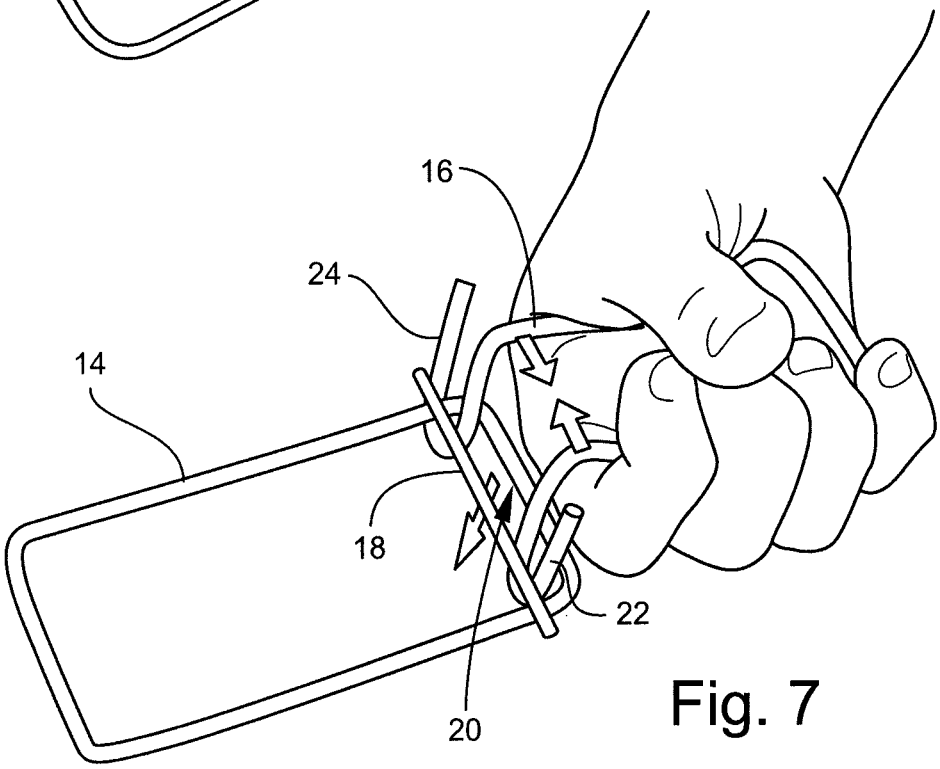
FIG. 7 shows the first and second hooks being compressed together to engage the second hook and the anchor bracket.

Referring specifically to FIGS. 4 and 5, the first step involves lowering hook 24 (i.e. the hook having a longer length) down into slot 20, with the two legs of hook 24 positioned on opposite sides of anchor bracket 14. Referring specifically to FIG. 6, pintle 16 is then rotated clockwise, as shown, inverting hook 24 and bringing hook 22 towards slot 20. Referring specifically to FIG. 7, because the distance between hooks 22 and 24 is greater than the width of slot 20, pintle 16 is then squeezed to narrow the distance between hooks 22 and 24 sufficiently to permit hook 22 to be inserted into slot 20. With both hooks 22 and 24 inserted in slot 20, they are fully lowered into slot 20 sufficiently to allow pintle 16 to spread back to its nominal width. Connection is complete, and the assembled masonry anchor 10 appears as shown in FIGS. 1 and 2. Alternative sequences of steps of attaching pintle 16 to anchor bracket 14 are possible to arrive at proper attachment.

Although specific embodiments of a masonry anchor 12 and methods of assembly are disclosed above, it is envisioned that various embodiments of the invention can be made without departing from its scope. Furthermore, the foregoing description of the preferred embodiment of the invention and the best mode for practicing the invention are provided for the purpose of illustration only and not for the purpose of limitation, the invention being defined by the claims.

What is claimed is:

1. A method for anchoring first and second spaced apart walls together to form a single wall structure, comprising the steps of:

(a) providing a masonry anchor comprising:

(1) an anchor bracket including a widthwise slot at an outer end thereof cooperatively formed by a portion of the anchor bracket and a cross-member spanning widthwise across the anchor bracket; and (2) a pintle engaging and carried by the anchor bracket and extending outwardly from the anchor bracket and bridging a cavity between the first and second walls, the pintle including first and second laterally spaced-apart hooks positioned and locked in the slot of the anchor bracket, the first and second hooks having a nominal spacing between the first and second hooks that is greater than a width of the slot, the first hook being longer than the second hook such that the first hook extends upwardly above the level of the cross-member when locked in the slot and the second hook ends in vertical alignment with the cross-member when locked in the slot;

(b) positioning the anchor bracket on top of a course of the first wall;

(c) connecting the first and second hooks of the pintle to the anchor bracket by:

(i) narrowing the spacing between the first and second hooks to a spacing that is less than the width of the slot;

(ii) inserting the first and second hooks in sequence into the slot of the anchor bracket; and (iii) returning the spacing between the first and second hooks to the nominal spacing thereby locking the first and second hooks in the slot;

(d) positioning the pintle on top of a course of the second wall in generally vertical spaced-apart alignment with the course of the first wall; and (e) embedding the anchor bracket and pintle in mortar.

2. A method for anchoring first and second spaced apart walls together according to claim 1, further including the step of forming the pintle of a material that is deformable by manual pressure to narrow the distance between the first and second hooks and has sufficient positional memory to return from its deformed position to its nominal spacing when manual pressure is released.

3. A method for anchoring first and second spaced apart walls together according to claim 2, further including the step of forming the anchor bracket and pintle of wire.

4. A method for anchoring first and second spaced apart walls together according to claim 1, wherein the masonry anchor further comprises a truss structure welded to and coplanar with the anchor bracket.

5. A method for anchoring first and second spaced apart walls together according to claim 1, wherein the pintle is movable in a vertical direction relative to the anchor bracket when the pintle is engaged with the anchor bracket.

6. A method for anchoring first and second spaced apart walls together according to claim 1, wherein the masonry anchor further comprises a seismic clip attached to an end of the pintle opposite the first and second hooks, wherein the seismic clip defines a plurality of parallel slots that receive an elongate rod therein.

7. A masonry anchor for connecting first and second spaced-apart walls defining a cavity therebetween, comprising:

(a) an anchor bracket including a widthwise slot at an outer end thereof cooperatively formed by a portion of the anchor bracket and a cross-member spanning widthwise across the anchor bracket; and (b) a pintle engaging and carried by the anchor bracket and extending outwardly therefrom and bridging a cavity between the first and second walls, the pintle including first and second laterally spaced-apart hooks positioned and locked in the slot of the anchor bracket, the first and second hooks having a nominal spacing between the first and second hooks that is greater than a width of the slot, the first and second hooks being deformable into a position wherein the first and second hooks are spaced apart by a distance that is less than the width of the slot for allowing the first and second hooks to be inserted into the slot in sequence, and further having sufficient positional memory to return from a deformed position to the spacing when manual pressure is released, the first hook being longer than the second hook such that the first hook extends upwardly above the level of the cross-member when locked in the slot and the second hook ends in vertical alignment with the cross-member when locked in the slot.

8. A masonry anchor according to claim 7, wherein the anchor bracket and the pintle are formed of wire.

9. A masonry anchor according to claim 7, wherein the anchor bracket is constructed of wire formed into a predefined shape defining a central void.

10. A masonry anchor according to claim 7, wherein the anchor bracket is constructed of wire formed into a frame having a quadrilateral periphery defining a central void, and further wherein the cross-member is welded to the wire.

11. A masonry anchor according to claim 7, wherein the anchor bracket is constructed of wire formed into a frame having a rectangular periphery defining a central void, and further wherein the slot in the anchor bracket is formed by the cross-member attached to the wire across opposed parallel portions of the wire adjacent an outer end of the anchor bracket.

12. A masonry anchor according to claim 7, further comprising a truss structure welded to and coplanar with the anchor bracket.

13. A masonry anchor according to claim 12, wherein the anchor bracket, the pintle and the truss structure are coplanar.

14. A masonry anchor according to claim 7, wherein the pintle is movable in a vertical direction relative to the anchor bracket when the pintle is engaged with the anchor bracket.

15. A masonry anchor according to claim 7, further comprising a seismic clip attached to an end of the pintle opposite the first and second hooks, wherein the seismic clip defines a plurality of parallel slots that receive an elongate rod therein.

* * * * *

UNITED STATES PATENT AND TRADEMARK OFFICE

CERTIFICATE OF CORRECTION

PATENT NO. : 8,418,422 B2
APPLICATION NO. : 13/010821
DATED : April 16, 2013
INVENTOR(S) : Ralph O. Johnson, III It is certified that error appears in the above-identified patent and that said Letters Patent is hereby corrected as shown below:

In the Claims:

On column 2, claim 7 (b) line 41 please add the word "nominal" before the words "spacing when manual...."

Signed and Sealed this
Twenty-first Day of May, 2013

Teresa Stanek Rea
*Acting Director of the United States Patent and Trademark Office*